US006698705B2

(12) United States Patent
Toghanian

(10) Patent No.: US 6,698,705 B2
(45) Date of Patent: Mar. 2, 2004

(54) PAINT EASEL AND DISPLAY RACK ASSEMBLY

(76) Inventor: Jahanbakhsh Toghanian, 1021 6th St., #203, Santa Monica, CA (US) 90403

( * ) Notice: Subject to any disclaimer, the term of this patent is extended or adjusted under 35 U.S.C. 154(b) by 0 days.

(21) Appl. No.: 10/283,995

(22) Filed: Oct. 29, 2002

(65) Prior Publication Data

US 2003/0080272 A1 May 1, 2003

Related U.S. Application Data

(60) Provisional application No. 60/336,421, filed on Oct. 30, 2001.

(51) Int. Cl.[7] ..... A47B 97/04

(52) U.S. Cl. ..... 248/448; 248/441.1

(58) Field of Search ..... 248/441.1, 448, 248/125.1, 125.2, 125.7, 124.1, 447, 460; 108/6, 97, 98, 42, 95, 107; 312/231, 233

(56) References Cited

U.S. PATENT DOCUMENTS 498,578 A * 5/1893 Schmirk
2,908,465 A * 10/1959 Lykes
4,154,173 A * 5/1979 Chesnut ..... 108/6
4,431,156 A * 2/1984 Mena ..... 248/445
4,856,749 A * 8/1989 Habermann ..... 248/448
4,938,153 A * 7/1990 Maes ..... 108/128
5,160,104 A * 11/1992 Sher ..... 248/176
5,242,145 A * 9/1993 Linnell ..... 248/449

FOREIGN PATENT DOCUMENTS

FR 2 822 103 A1 * 3/2001

* cited by examiner

*Primary Examiner*—Gwendolyn Baxter
(74) *Attorney, Agent, or Firm*—Kelly Bauersfeld Lowry & Kelley

(57) ABSTRACT

An adjustable paint easel and display rack assembly includes a base having first and second legs extending upwardly therefrom. First and second risers are slidably connected to the first and second legs for adjusting the height of the assembly. Extensions may be pivotally attached to upper ends of the risers and movable between folded and extended positions to further adjust the height of the assembly. An arm is attached to the risers or extensions and has a canvas board platform pivotally and rotatably attached thereto, enabling the height and angle of the canvas board platform to be adjusted. The assembly may include pivoting table leaves, and model attachment plates as well.

25 Claims, 7 Drawing Sheets

10
6
8
7
12
14
16
18
20
22
24
26
30
36
38
40

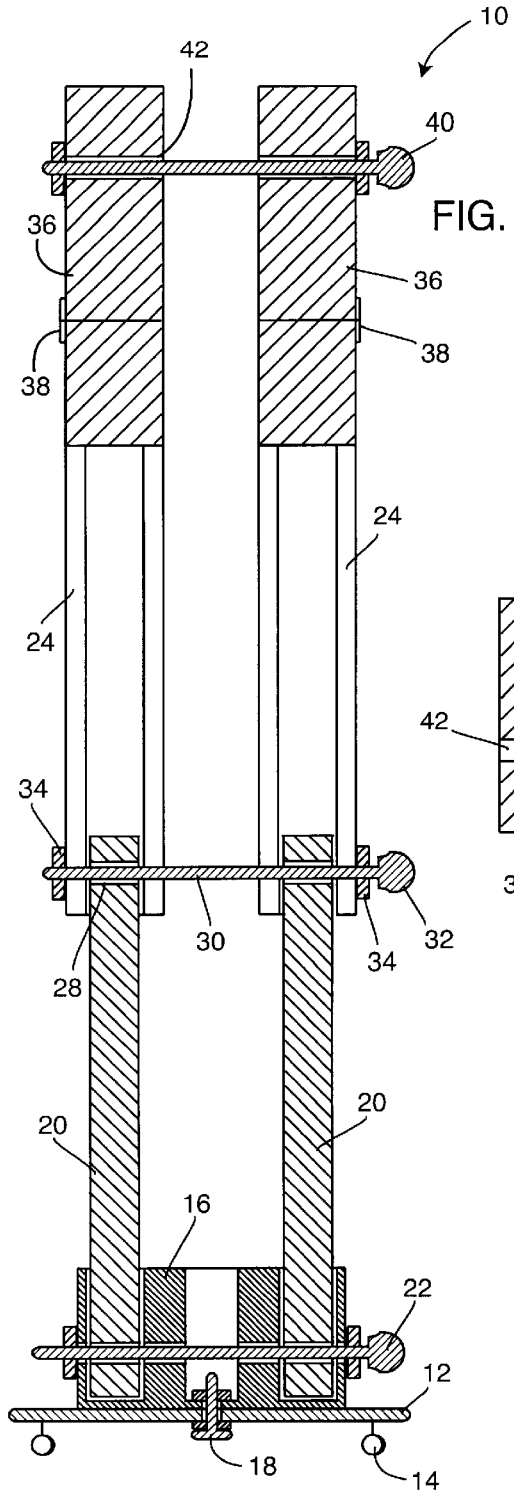
FIG. 6
FIG. 7
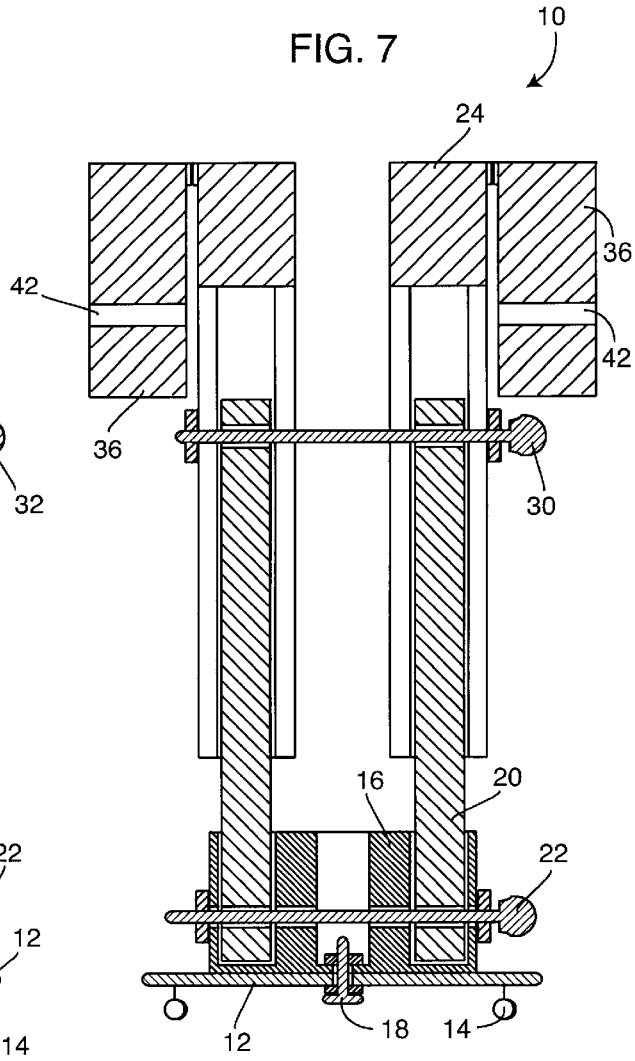

PAINT EASEL AND DISPLAY RACK ASSEMBLY

RELATED APPLICATION

This application claims priority from U.S. Provisional Application No. 60/336,421, filed Oct. 30, 2001.

BACKGROUND OF THE INVENTION

The present invention generally relates to paint easels. More particularly, the present invention relates to a paint easel and display rack which is adjustable in orientation and height for the benefit of the artist.

Paint easels have been in existence for hundreds of years. Some easels are relatively small and lightweight and allow an artist to work outside of the convenience of a studio. Others are relatively immobile and large, but allow an artist to securely fix canvas thereon to paint.

However, the current design of easels, particularly studio easels, present certain disadvantages. Oftentimes, the easel is at a predetermined height, requiring the artist to either stand or sit upon a stool or the like to paint the canvas. Due to the relatively fixed position of the canvas, the artist must adjust his or her position and height with respect to the canvas board. Another problem experienced by artists is that the artist must place himself or herself in awkward positions to paint various areas on the canvas board. For example, the canvas board is typically fixed in position, with some easels allowing a little latitude or movement in the vertical and horizontal directions. None allow the canvas board to be rotated or placed into a completely flat orientation. This requires the artist to remove the canvas board from the easel and place it upon a table or other flat surface, and rotate the canvas board upon the table, to paint certain areas of the canvas.

Yet another problem encountered by many artists is the positioning of models which are to be illustrated. The model, such as a book, shoe, etc., is placed on a table or the like and drawn. The artist must manually move the model to obtain other viewpoints. In a group setting, such as an art class, the teacher has reverted to hanging a single model from the ceiling so that all students can view the model form the same general orientation with as much of the model viewable from their angle as possible.

Accordingly, there is a continuing need for an easel which is adjustable in height, mobile, capable of moving the canvas board into many different orientations, and capable of movably mounting a model thereto. The present invention fulfills these needs and provides other related advantages.

SUMMARY OF THE INVENTION

The present invention resides in a paint easel and display rack assembly which is adjustable, whereby the height and angle of a canvas board can be altered to suit the needs of the artist. The assembly generally comprises a base having first and second legs extending upwardly therefrom. First and second risers are slidably connected to the first and second legs, respectively, and able to be locked into position. In a particularly preferred embodiment, the risers and legs include apertures or slots configured to receive a clamping device for locking the risers in position. The clamping device may comprise a rod inserted through the aperture or slots and having a clamping plate at an end thereof. Thus, the height of the assembly can be adjusted by adjusting the position of the risers with respect to the legs. Additionally, extensions may be pivotally attached to upper ends of the risers and movable between folded and extended positions to further adjust the height of the assembly.

An arm is attached to the risers or extensions. Preferably, the arm is removably attached so as to be positioned at the proper height. A canvas or platform is pivotably and rotatably attached to the arm. This enables the canvas board to be tilted and turned to the proper orientation relative to the artist.

A support stand may be attached to the legs or risers. The support stand includes multiple table leaves which are pivotally attached to the support stand for supporting paint brushes, paints, etc.

In a particularly preferred embodiment, a model attachment member is attached to the legs or risers. The model attachment member includes plates which can be pivoted and turned so as to be properly oriented. The plates include apertures therethrough for securing models to the plates.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 6 is a cross-sectional view taken generally along line 6—6 of FIG. 1;

FIG. 7 is a cross-sectional view taken generally along line 7—7 of FIG. 5;

DETAILED DESCRIPTION OF THE PREFERRED EMBODIMENTS

Figures 1, 2, 3, 4, 5:
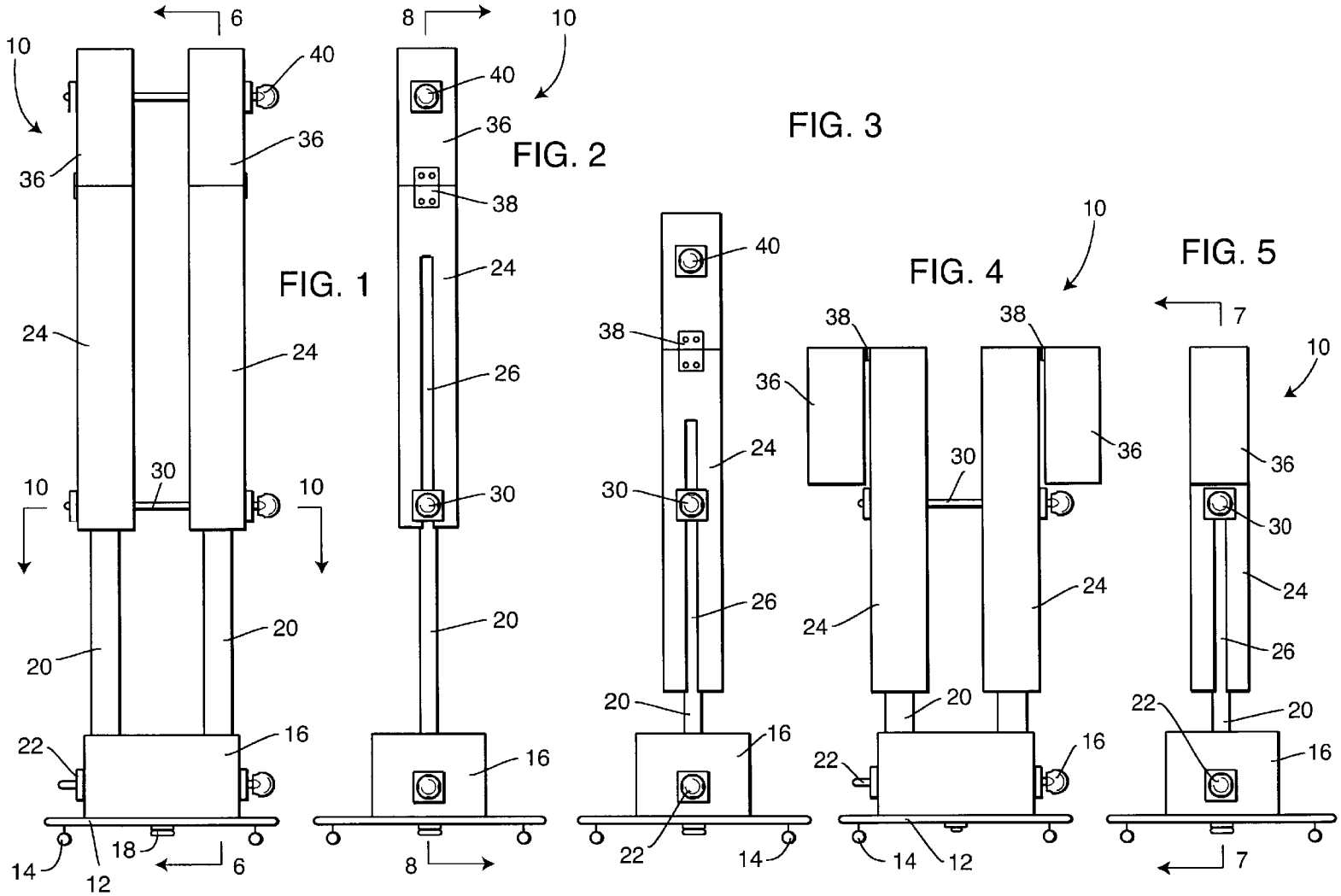
FIG. 1 is a front elevational view of an easel assembly embodying the present invention in a fully extended state.
FIG. 2 is a side elevational view of the assembly of FIG. 1.
FIG. 3 is a side elevational view of the assembly of FIG. 1, in a partially extended state.
FIG. 4 is a front elevational view of the assembly of FIG. 3, illustrating top members thereof hinged downwardly.
FIG. 5 is a side elevational view of the assembly configuration of FIG. 4.
Figure 8:
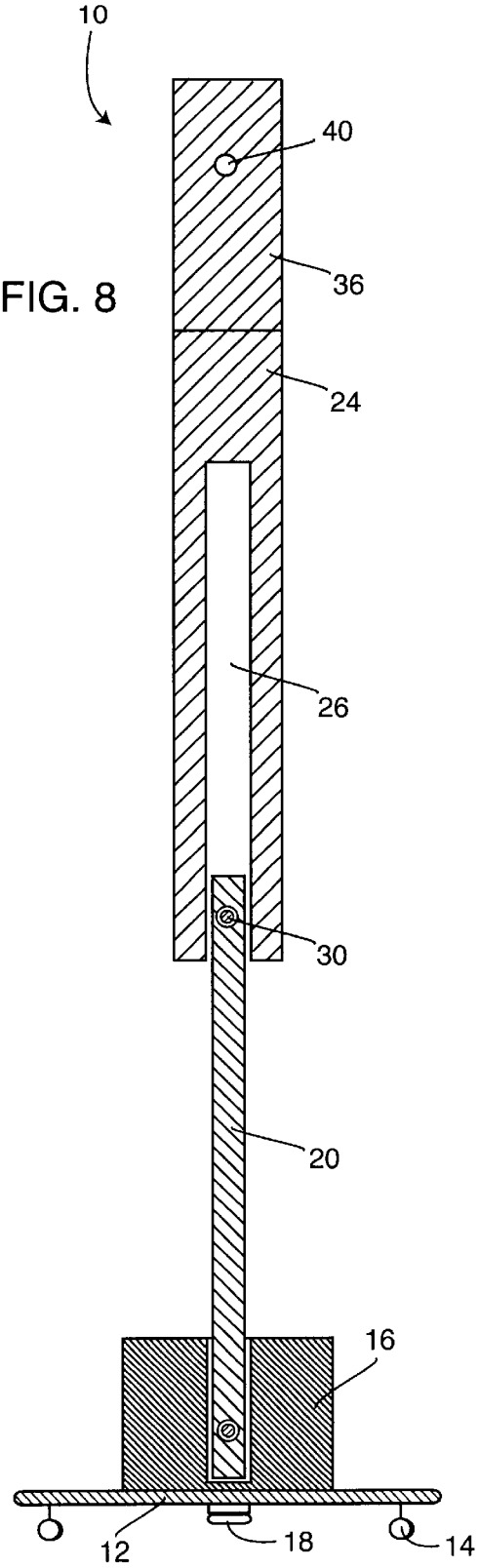
FIG. 8 is a cross-sectional view taken generally along line 8—8 of FIG. 2.
Figure 10:
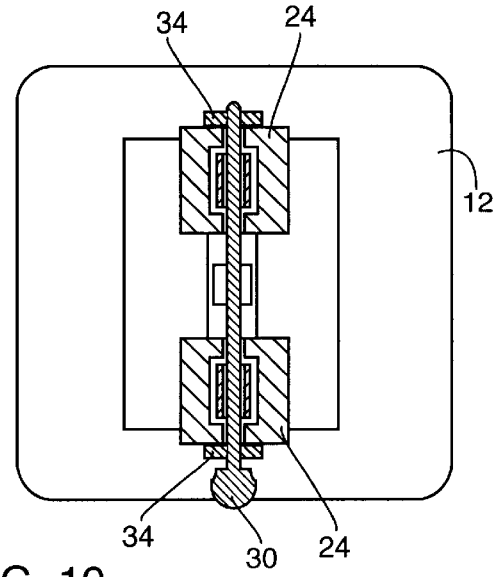
FIG. 10 is a top cross-sectional view taken generally along line 10—10 of FIG. 1, illustrating a support screw used to adjust the height of the assembly.
Figure 9:
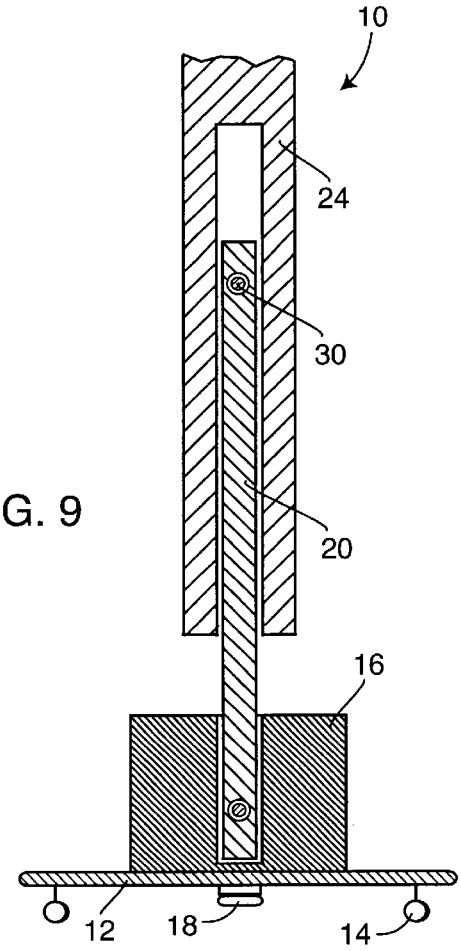
FIG. 9 is a partially fragmented cross-sectional view similar to FIG. 8, illustrating the assembly in a partially extended state.

As shown in the drawings for purposes of illustration, the present invention resides in an easel assembly, generally referred to by the reference number 10, which is adjustable and includes attachments which are designed to aid the artist.

With reference to FIGS. 1–10, the easel 10 includes a base 12 which preferably has wheels 14 or the like attached to a bottom surface thereof so that the easel 10 can be moved easily from one location to another. A supportive box structure 16 is removably attached to the base 12 via a thumb screw 18 or the like and into which multiple legs 20 extend upwardly therefrom. The legs 20 are removably attached to the box 16 by a screw 22 extending through the box 16 and legs 20 so as to hold the legs 20 in position.

The legs 20 are sized such so as to fit within hollow risers 24, each having an elongated slot 26 extending substantially the length thereof. Apertures 28 are formed through each leg 20 so as to be generally aligned and allow a screw 30, or a rod or the like, to be placed therethrough to clamp the risers 24 to the legs 20. Typically, the screw 30 includes a hand knob 30 at one end thereof and clamping brackets 32 which are threadably attached to the screw 30 and which are positionable on opposite sides of the easel 10 so that as the hand knob 30 is increasingly rotated, the clamping brackets 32 compress against opposing sides of the risers 24 and hold the risers 24 in place. Thus, the screw 30 can be loosened and the risers 24 raised or lowered depending upon the need of the artist, as illustrated in FIGS. 2, 3, 6 and 7.

Extension members 36 are pivotally attached to the upper ends of the risers 24 by hinges 38 in order to provide more height to the easel 10 when such height becomes necessary, such as when the artist is standing and working on a relatively large canvas. A screw 40 extends through apertures 42 of the extension members 26 to hold the extension members 36 in an upright and fully extended position. As will be described more fully herein, the screw 40 also serves as an attachment point for other components of the easel 10. Thus, it will be appreciated by the reader that not only can the easel 10 be adjusted in height by adjusting the positioning of the legs 20 within the risers 24, but also by the extension or folding over of the extension members 36.

With reference now to FIGS. 11–16, an arm 44 is attachable to the easel 10 via connection with either screw 30 or 40 extending through an aperture 46 thereof so as to extend generally vertical with respect to the predominant plane of the easel 10. The arm 44 thus rests generally in a horizontal orientation and supports a canvas board platform 48 at an end thereof. The canvas board platform 48 is sized and configured such to removably receive canvas thereon.

Figure 11:
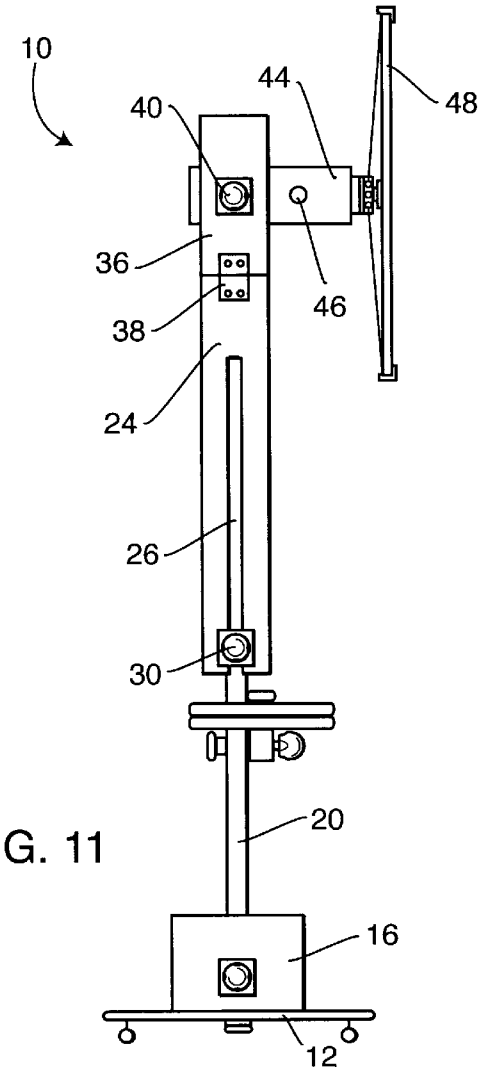
FIG. 11 is a side elevational view of the assembly having a canvas board platform attached thereto.
Figure 12:
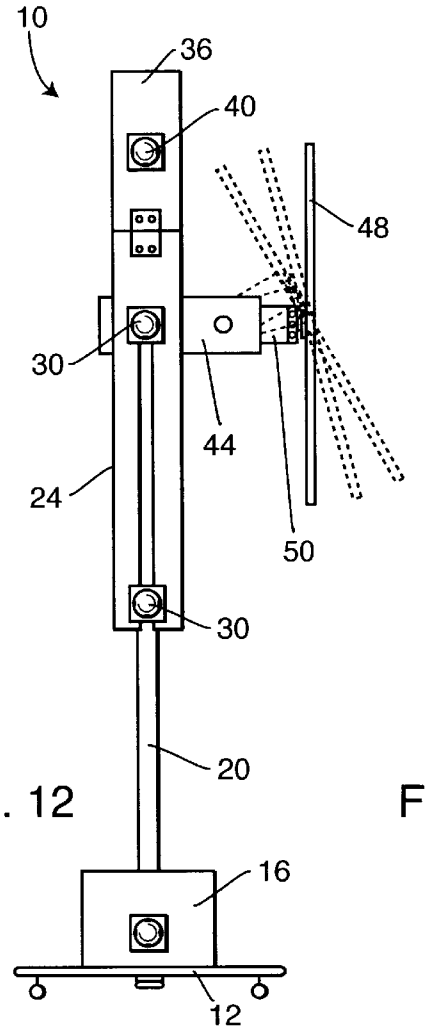
FIG. 12 is a side elevational view similar to FIG. 11, illustrating the movement of the canvas board platform in accordance with the present invention.
Figure 13:
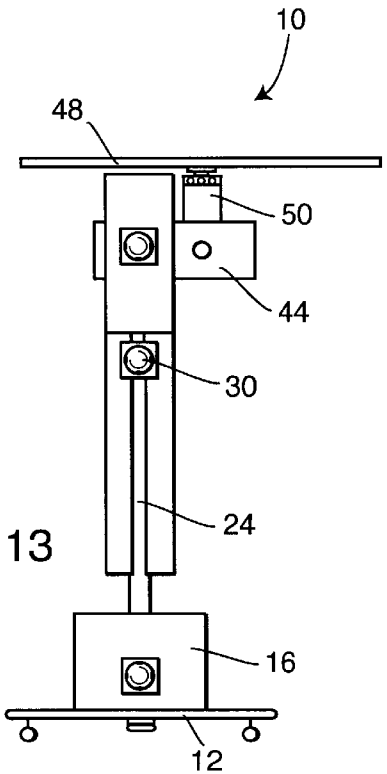
FIG. 13 is a side elevational view of the assembly in a lowered state, and having the canvas board platform positioned at a generally horizontal orientation.

As shown in FIGS. 11–13, the arm 44 includes a jointed extension 50 which is pivotally attached to the arm 44 so as to be raised and lowered to alter the angle of the canvas board platform 48 with respect to the artist. As shown in FIG. 13, the easel 10 can be reduced to its lowest height by inserting the legs 20 fully within the extension members 24, and pivoting the arm extension joint 50 completely vertical so that the canvas board platform 48 lies in a horizontal position. Although the canvas board platform 48 could be pivoted into the fully horizontal position above the fully extended extension members 36, such a position would require that the artist stand upon a chair or the like in order to paint on the canvas. By lowering the easel into its shortest state, as illustrated in FIG. 13, the artist is able to remain seated, or stand over the canvas board platform 48 in order to continue painting.

Figure 14:
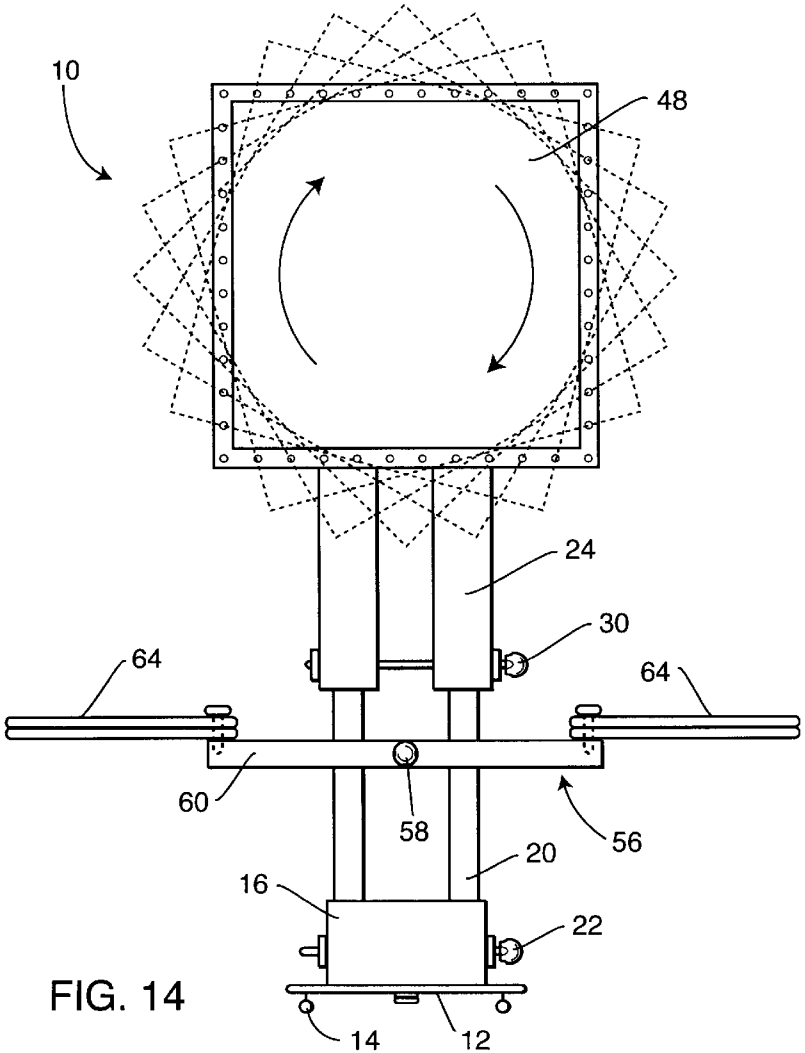
FIG. 14 is a front elevational view of the assembly, illustrating the rotation of the canvas board platform in accordance with the present invention.
Figure 16:
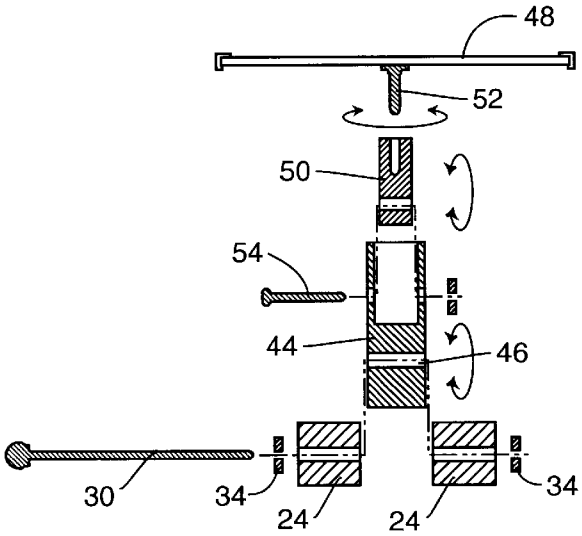
FIG. 16 is an exploded cross-sectional view taken generally along lines 16—16 of FIG. 15, illustrating the interconnection and movements of components of the assembly to permit the movement of the canvas board platform.

As illustrated in FIG. 14, the canvas board platform 48 is also rotatable so that the artist can position the canvas board platform 48, and thus the canvas, at any desired position. As shown in FIG. 16, the movements of the canvas board platform 48 are allowed by inserting a screw 52 extending from the rear surface of the canvas board platform 48 into the arm extension joint 50, which is pivotally attached to the arm 44 via a bolt 54 or the like which extends through the arm 44 and joint 50. The arm 44 includes an aperture 46 through which the screw 30 is inserted so that as the screw 30 is clamped onto the risers 24, the arm 44 is clamped in place as well. Thus, the canvas board platform 48 can be raised or lowered, tilted and rotated to be conveniently position for the artist.

Figure 15:
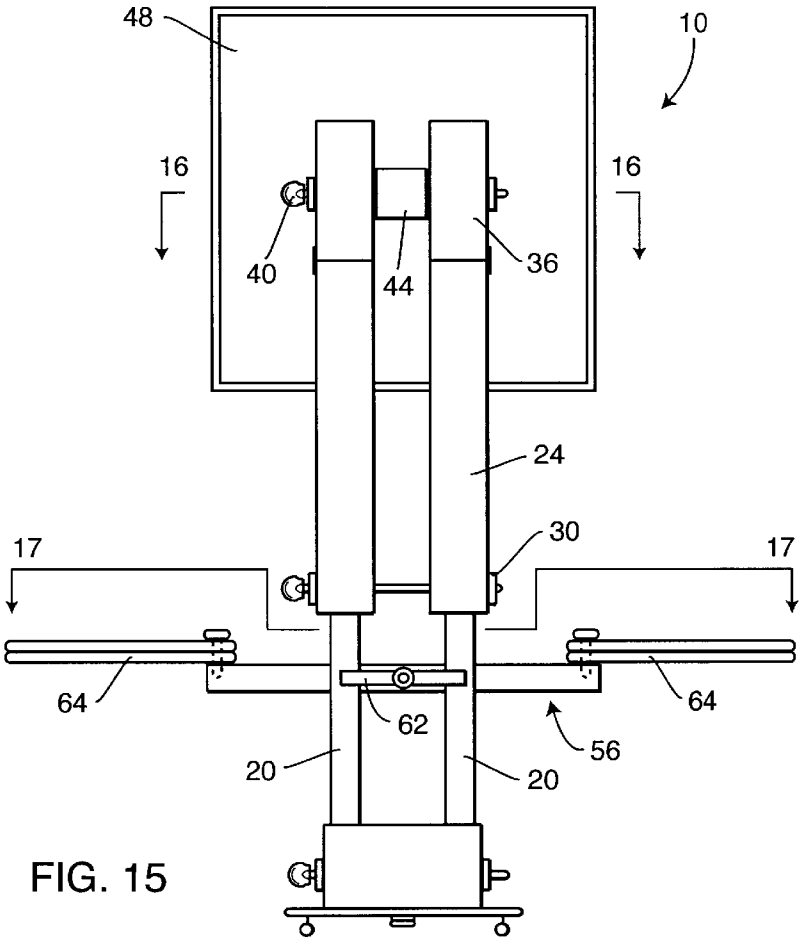
FIG. 15 is a rear elevational view of the assembly and canvas board platform of FIG. 14.
Figure 17:
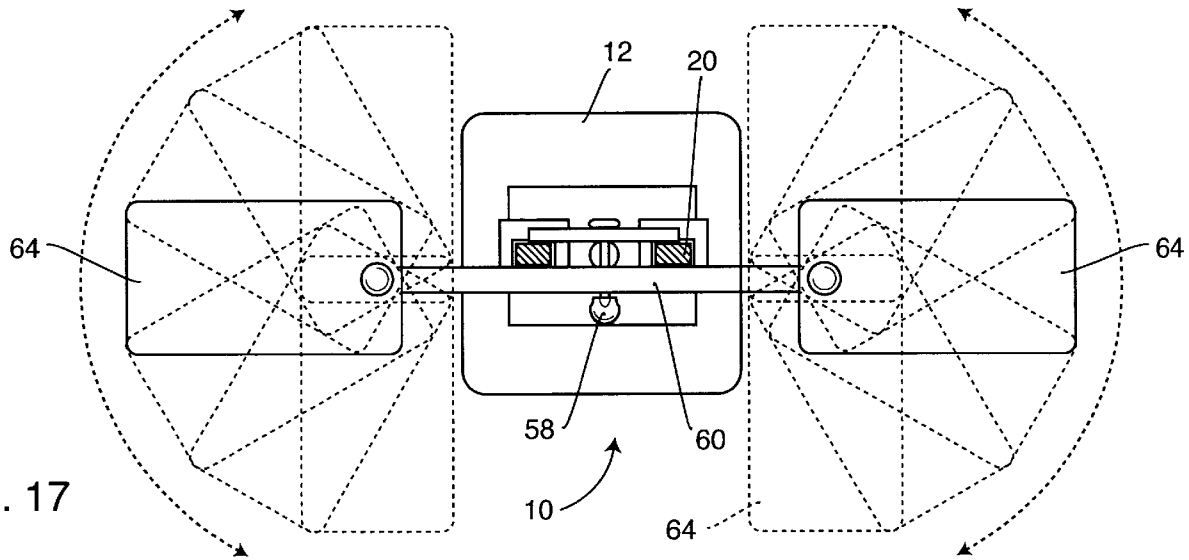
FIG. 17 is a top view taken generally along line 17—17 of FIG. 15, and illustrating movement of table leaves in accordance with the present invention.

With reference now to FIGS. 14 and 15, a support stand 56 is removably secured to the legs 20 of the easel 10 by a screw 58 extending through a main beam 60 of the support stand 56 which tightens a crossbar 62 that is threadably attached to the screw 58 against the opposing legs 20 to hold the support stand 56 in place. Two pairs of table leaves 64 are pivotally attached to the support stand beam 60 on opposite ends thereof and serve to hold brushes, oils, and other necessary instruments for the artist. As illustrated in FIG. 17, the leaves 64 are pivotal with respect to one another so that a larger supporting surface area is provided when needed, and the leaves 64 can be moved so as not to impede the artist.

Figures 18, 19, 20:
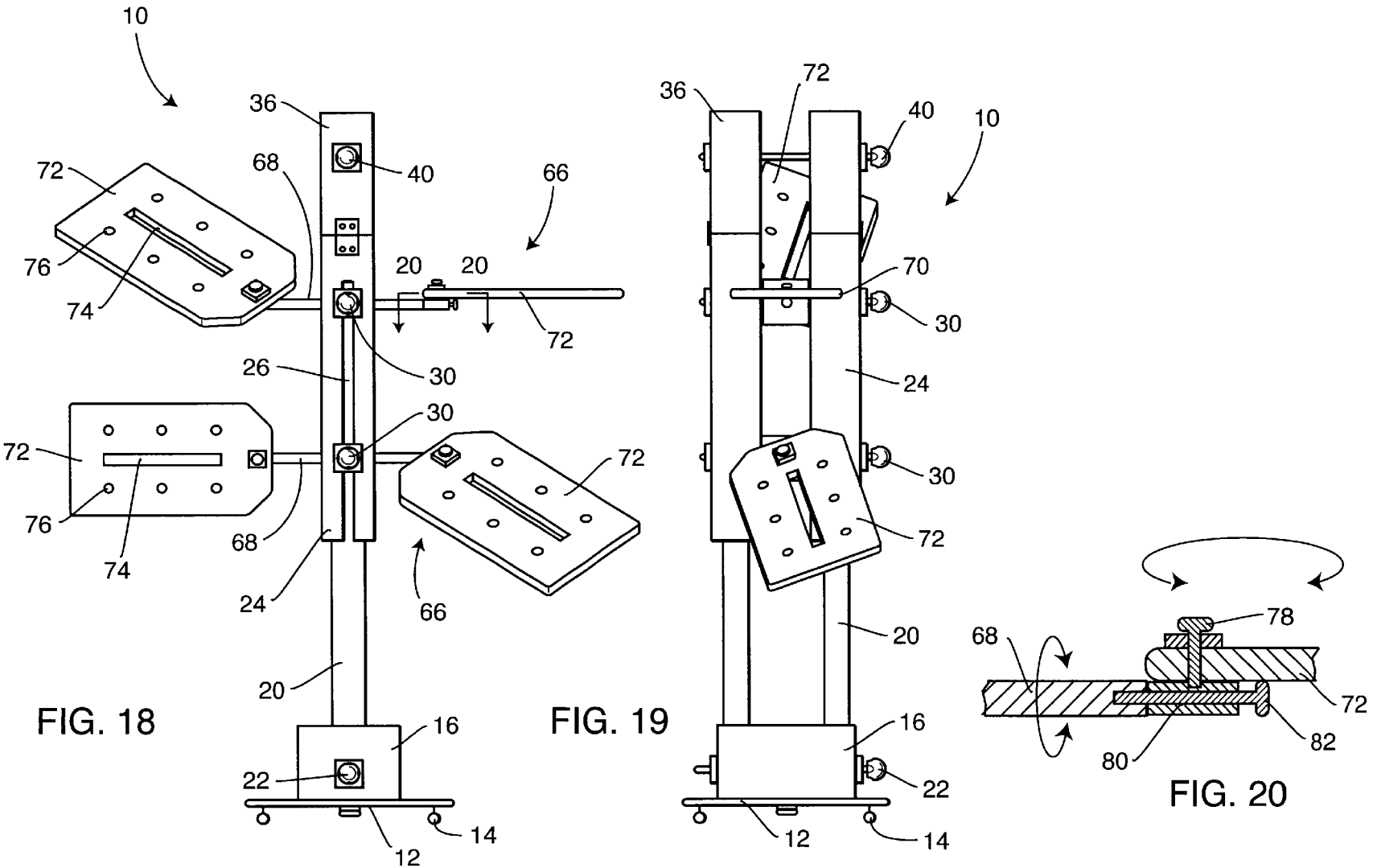
FIG. 18 is a side perspective view of the assembly having model attachments connected thereto.
FIG. 19 is a front elevational view of the assembly of FIG. 18.
FIG. 20 is a cross-sectional view taken along line 20—20 of FIG. 18, illustrating the movements of the model attachments.

With reference now to FIGS. 18–20, as mentioned above, there is a continuing problem with the positioning of models which are to be illustrated. The present invention may include model attachment members 66 having beams 68 extending through the gap between the legs 20 and risers 24 and having screws which tighten a crossbar 70, as described above. A model attachment plate 72 is movably attached to each end of the beams 68. Each plate includes a central elongated slot 74 and a plurality of apertures 76 spaced throughout the surface of the plate 72. This allows a model to be secured to the plate by means of wire, twine, a thumb screw extending into the model, etc.

As illustrated in FIG. 20, each plate 72 is movably attached to the end of the beam 68 by a screw or bolt 78 extending through the plate 72 and into a foot 80, also having a screw or bolt 82 extending into the end of the beam 68. Thus, the foot can be rotated along one axis, whereas the plate 72 can be rotated upon a transverse axis so that the plate 72 can be positioned to nearly any desired angle so that the model attached thereto can be illustrated from any given angle. This can be particularly useful in the classroom setting where a single easel 10 can support many models simultaneously, or the same model at different angles so that the art students can illustrate the model object from various angles. Of course, the plates 72 are also useful for a single artist using the easel 10 as the artist can have the model in close proximity to the easel 10, and move the orientation of the model by moving the plate 72 and retaining the model in such orientation as long as desired.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. An adjustable paint easel and display rack assembly, comprising:

a base;

first and second legs extending upwardly from the base;

first and second risers slidably connected to the first and second legs, respectively, and selectively locked into position;

an arm attached to the risers and having a canvas board platform pivotally attached thereto, whereby the height and angle of the canvas board platform can be adjusted; and a support stand attached to the legs or risers and having table leaves.

2. The assembly of claim 1, wherein the risers and legs include apertures or slots configured to receive a clamping device for locking the risers in position.

3. The assembly of claim 2, wherein the clamping device comprises a rod insertable through the apertures or slots and having a clamping plate at an end thereof.

4. The assembly of claim 1, including extensions pivotally attached to upper ends of the risers and movable between folded and extended positions to further adjust the height of the assembly.

5. The assembly of claim 4, wherein the arm is removably attached to either the risers or the extensions.

6. The assembly of claim 1, wherein the canvas board platform is rotatably attached to the arm.

7. The assembly of claim 1, wherein the table leaves comprise a plurality of table leaves pivotally attached to the support stand.

8. The assembly of claim 1, including a model attachment member attached to the legs or risers.

9. The assembly of claim 8, wherein the model attachment member includes plates pivotally attached to the member so as to be selectively oriented.

10. The assembly of claim 9, wherein the plates include apertures for securing models thereto.

11. The assembly of claim 1, including wheels attached to the base.

12. An adjustable paint easel and display rack assembly, comprising:

a base;

first and second legs extending upwardly from the base and including apertures or slots therethrough;

first and second risers slidably connected to the first and second legs, respectively and including apertures or slots therethrough for alignment with the apertures or slots of the legs for reception of a clamping device for locking the risers in position;

extensions pivotally attached to upper ends of the risers and movable between folded and extended positions;

an arm attached to the risers or the extensions;

a canvas board platform pivotally and rotatably attached to the arm, whereby the height and angle of the canvas board platform can be adjusted; and a model attachment member attached to the legs or risers and including plates pivotally attached thereto so as to be selectively oriented.

13. The assembly of claim 12, wherein the clamping device comprises a rod insertable through the apertures or slots and having a clamping plate at an end thereof.

14. The assembly of claim 12, wherein the arm is removably attached to either the risers or the extensions.

15. The assembly of claim 12, including a support stand attached to the legs or risers and having a plurality of table leaves pivotally attached thereto.

16. The assembly of claim 12, wherein the plates include apertures for securing models thereto.

17. The assembly of claim 12, including wheels attached to the base.

18. An adjustable paint easel and display rack assembly, comprising:

a base having wheels attached thereto;

first and second legs extending upwardly from the base and including apertures or slots therethrough;

first and second risers slidably connected to the first and second legs, respectively and including apertures or slots therethrough for alignment with the apertures or slots of the legs for reception of a clamping device for locking the risers in position;

extensions pivotally attached to upper ends of the risers and movable between folded and extended positions;

an arm removably attached to either the risers or the extensions;

a canvas board platform pivotally and rotatably attached to the arm, whereby the height and angle of the canvas board platform can be adjusted; and a support stand attached to the legs or risers and having a plurality of table leaves pivotally attached thereto.

19. The assembly of claim 18, wherein the clamping device comprises a rod insertable through the apertures or slots and having a clamping plate at an end thereof.

20. The assembly of claim 18, including a model attachment member attached to the legs or risers and including plates pivotally attached thereto so as to be selectively oriented, the plates including apertures therethrough for securing models thereto.

21. The assembly of claim 18, including wheels attached to the base.

22. An adjustable paint easel and display rack assembly, comprising:

a base;

first and second legs extending upwardly from the base;

first and second risers slidably connected to the first and second legs, respectively, and selectively locked into position;

an arm attached to the risers and having a canvas board platform pivotally attached thereto, whereby the height and angle of the canvas board platform can be adjusted; and a model attachment member attached to the legs or risers, wherein the model attachment member includes plates pivotally attached to the member so as to be selectively oriented.

23. The assembly of claim 22, wherein the plates include apertures for securing models thereto.

24. An adjustable paint easel and display rack assembly, comprising:

a base;

first and second legs extending upwardly from the base and including apertures or slots therethrough;

first and second risers slidably connected to the first and second legs, respectively and including apertures or slots therethrough for alignment with the apertures or slots of the legs for reception of a clamping device for locking the risers in position;

extensions pivotally attached to upper ends of the risers and movable between folded and extended positions;

an arm attached to the risers or the extensions;

a canvas board platform pivotally and rotatably attached to the arm, whereby the height and angle of the canvas board platform can be adjusted; and a support stand attached to the legs or risers and having a plurality of table leaves pivotally attached thereto.

25. An adjustable paint easel and display rack assembly, comprising:

a base having wheels attached thereto;

first and second legs extending upwardly from the base and including apertures or slots therethrough;

first and second risers slidably connected to the first and second legs, respectively and including apertures or slots therethrough for alignment with the apertures or slots of the legs for reception of a clamping device for locking the risers in position;

extensions pivotally attached to upper ends of the risers and movable between folded and extended positions;

an arm removably attached to either the risers or the extensions;

a canvas board platform pivotally and rotatably attached to the arm, whereby the height and angle of the canvas board platform can be adjusted; and a model attachment member attached to the legs or risers and including plates pivotally attached thereto so as to be selectively oriented, the plates including apertures therethrough for securing models thereto.

* * * * *